US006637249B1

(12) United States Patent
Heikkilä

(10) Patent No.: US 6,637,249 B1
(45) Date of Patent: Oct. 28, 2003

(54) DEVICE FOR MANUFACTURING METAL OBJECTS

(75) Inventor: Irma Heikkilä , Järfälla (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/031,653

(22) PCT Filed: May 12, 2000

(86) PCT No.: PCT/FI00/00430

§ 371 (c)(1),
(2), (4) Date: Apr. 9, 2002

(87) PCT Pub. No.: WO00/71275

PCT Pub. Date: Nov. 30, 2000

(30) Foreign Application Priority Data

May 21, 1999 (FI) ..... 991164

(51) Int. Cl.[7] ..... B21C 23/00
(52) U.S. Cl. ..... 72/262
(58) Field of Search ..... 72/262, 46, 47, 72/258, 271, 700

(56) References Cited

U.S. PATENT DOCUMENTS

| | | | | | |
|---|---|---|---|---|---|
| 4,044,587 | A | * | 8/1977 | Green et al. | 72/262 |
| 4,650,408 | A | * | 3/1987 | Anderson et al. | 72/262 |
| 4,953,382 | A | * | 9/1990 | Ashok et al. | 72/262 |

FOREIGN PATENT DOCUMENTS

| | | | | |
|---|---|---|---|---|
| GB | 1370894 | | 10/1974 | |
| GB | 2103133 | * | 2/1983 | 72/262 |
| GB | 2208618 | * | 4/1989 | 72/262 |
| JP | 59-209419 | * | 11/1984 | 72/262 |
| WO | 83/00299 | * | 2/1983 | 72/262 |

* cited by examiner

*Primary Examiner*—Ed Tolan
(74) *Attorney, Agent, or Firm*—Morgan & Finnegan, LLP

(57) ABSTRACT

This invention relates to a device for producing copper or copper based metal objects in a continuously operated extrusion device, where the material to be extruded is brought to the extrusion member in a groove formed on the circumference of a feed member made to rotate. According to the invention, in the groove (3,10) of said feed member, coated with a metal coating (8,11), the ratio of the groove width to the groove height is within the range 0.5–2.0.

11 Claims, 2 Drawing Sheets

DEVICE FOR MANUFACTURING METAL OBJECTS

Figure 1:
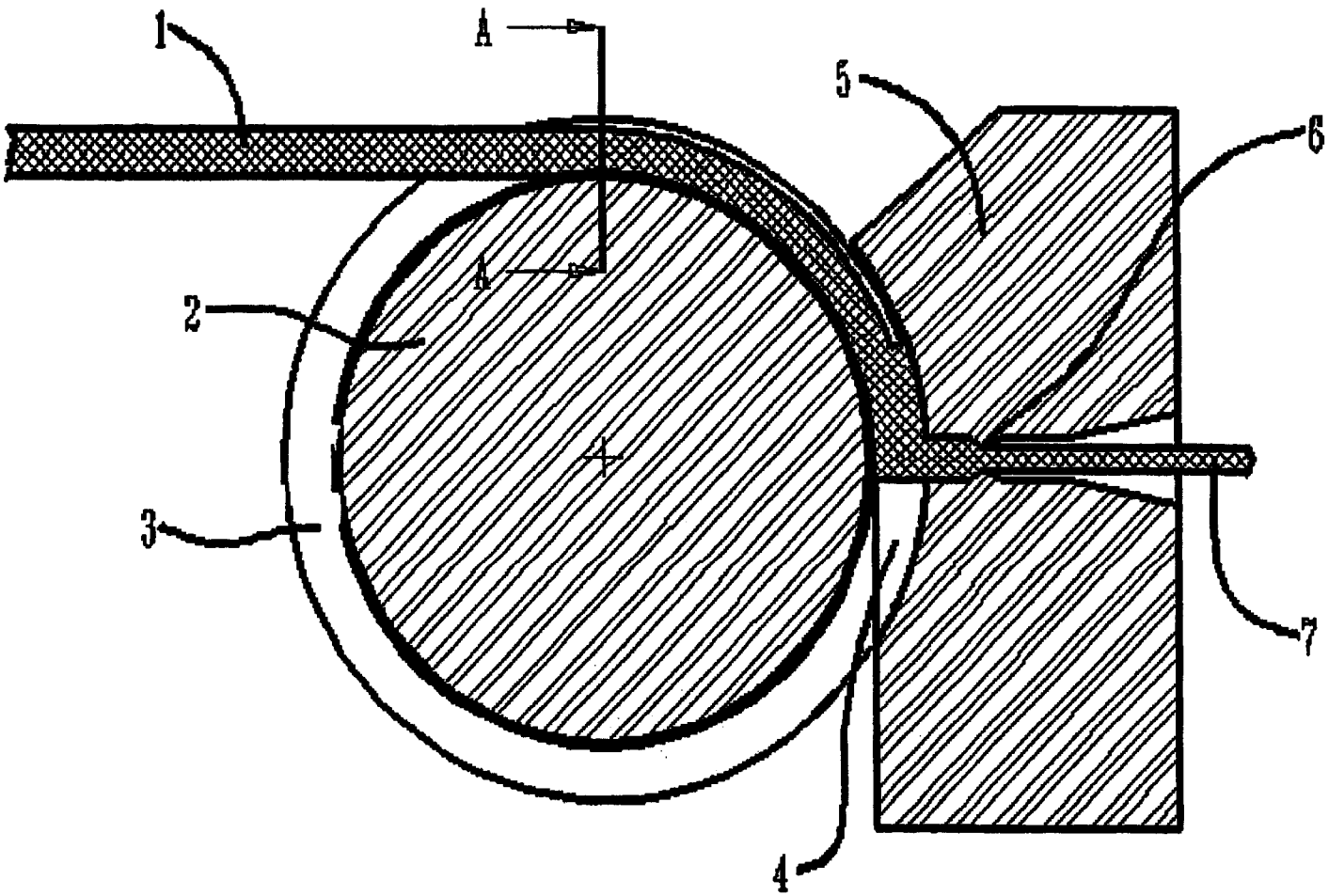

This application is a 35 USC 371 of PCT/FI00/00430 filed May 12, 2000.

The present invention relates to a device for manufacturing copper or copper-based metal objects by continuously operated extrusion, where the material to be extruded is fed to the extrusion member by means of a feed member that is made to rotate.

The GB patent No. 1,370,894 introduces a method where the material to be processed is fed to a groove between two separate members. In the practical applications of said method, the groove has a curved shape, in which case one member is a wheel, and the groove is formed on the circumference of the wheel. In the other member, there is formed an abutment that essentially fills said groove and forms a closed end for the groove. Further, in the vicinity of said closed end of the groove, there is made a extrusion aperture, through which the material to be processed is extruded to produce a metal object of the shape defined by the extrusion aperture.

In the continuously operated extrusion process according to the GB patent 1370894, the material to be extruded is conveyed to the extrusion proper. In connection with the extrusion process, the temperature of the material to be extruded rises to the range of 650–800° C., in which case the wheel is subjected to the influences of high temperature. At the same time, strain is directed to the wheel owing to the extrusion. On the other hand, when the wheel receives new material to be extruded, the wheel is for that part subjected to a lower temperature than during the extrusion process, and it does not suffer similar strain as in the extrusion range proper. Consequently, the wheel is at the different stages subjected to various temperature ranges and various intensities of strain. The wheel is among the most central members of the continuously operated extrusion device, but the working life of the wheel remains fairly low, among others due to the various tensions directed thereto at the different stages. Moreover, the structure of the wheel sets limitations to the design of the groove, which in turn enhances the creation of extrusion defects in the extrusion product. In addition, the design of the groove affects the tension distributions created in the wheel.

The object of the present invention is to alleviate the drawbacks of the prior art and to achieve a new and improved device for the continuously operated extrusion of copper or copper-based metal objects, in which device the shape of the groove formed in the wheel serving as the metal feed member, as well as the material used in the coating of said groove, essentially improve both the working life of the wheel and its operational behaviour. The essential novel features of the invention are apparent from the appended claims.

According to the invention, the material feed member provided in a continuously operated extrusion device of copper and copper-based metal objects is essentially wheel-shaped, and said feed member is installed supported on its axis, so that said feed member can be rotated around its axis. On the circumference of the wheel-shaped feed member, there is formed a groove, the outer surface of which groove advantageously forms part of the outer surface of the feed member. The groove formed on the circumference of the wheel-shaped feed member advantageously has two essentially parallel walls that are connected by a curved part constituting the bottom of said groove. The walls that are connected to the curved part constituting the groove bottom can also be at least partly curved, advantageously so that said walls approach each other when proceeding towards the groove aperture provided on the circumference of the feed member. Thus the groove has a profile that is essentially U-shaped or essentially near to a U-shaped profile. Further, the inner surface of the feed member groove is coated with a metal coating. By using the groove profile and metal coating according to the invention in the feed member groove, the working life of the feed member can be essentially increased, and at the same time both the yield and quality of the product obtained from the extrusion device can be improved. Moreover, the extended working life of the feed member reduces the time spent in the maintenance of the extrusion device and thus increases the degree of utilization of the continuously operated extrusion device.

According to the invention, the groove provided on the feed member circumference is designed so that the ratio of the groove width to the groove height is within the range of 0.5–2.0, advantageously 1.0–1.5, when measured at the widest and on the other hand highest spot of the groove. The groove provided on the outer circumference of the feed member can also be designed so that the inner surface of the groove is curved also in the vicinity of the aperture located near the surface of the circumference. In that case the widest spot of the groove is essentially deviant from the feed member circumference.

The coating material employed in the feed member groove is advantageously a metal, such as nickel, that is essentially well adhesive with the copper or copper-based material processed in the continuously operated extrusion device. The employed coating can also be some other metal, such as aluminium, zinc, cobalt, magnesium or silver, mixtures or compounds of these, or platinum or gold. Moreover, the employed coatings can be non-metallic coatings that are well adhesive with copper or copper-based materials. The thickness of the coating in the feed member groove is 1–1000 micrometers, advantageously 2–100 micrometers.

When employing, according to the invention, in the feed member of a continuously operated extrusion device, an essentially U-shaped or essentially near U-shaped groove, both the durability and operation of the feed member can advantageously be improved. The groove is now made mechanically durable, and it enables an additional optimization of the groove shape, so that roughening is not needed at the groove bottom. Further, thermal fluctuations in the vicinity of the feed member surface are reduced, and the heat transfer from the groove towards the inside of the feed member is distributed in a more advantageous fashion. Moreover, the quality of the product obtained from the extrusion is improved, because the flowing of the extruded material in the extrusion area is improved. As the quality of the extruded product is improved, the quantity of scrap created in the process is reduced; the reduced amount of scrap further reduces the thermal load on the feed member surface, and consequently the wearing of the feed member due to thermal fatigue.

The use of a coating that is well adhesive with copper or some copper-based material in the groove of the feed member of a continuously operated extrusion device results in that the lining provided in the groove sticks adhesively in place without any mechanical roughening of the groove surface, which would essentially speed up both the growing of fatigue crack and breaking of the feed member. Furthermore, the coating prevents a mechanical contact between the feed member and the material to be extruded, wherefore the chances that the extruded material should induce a brittleness in the feed member is essentially reduced. Moreover, the brittleness induced by the extruded material is essentially slighter on a smooth surface than on a roughened surface. In addition to these advantages, the coating according to the invention advantageously serves as a thermal preventive layer, slowing down heat conduction to the feed member, owing to which phenomenon the operation temperature of the feed member can be lowered.

Figure 2:
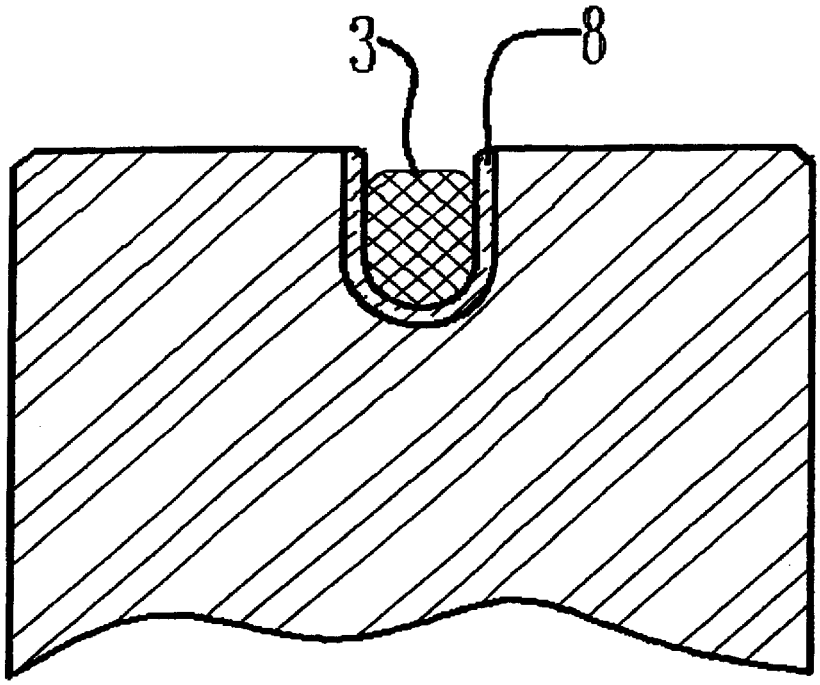
Figure 3:
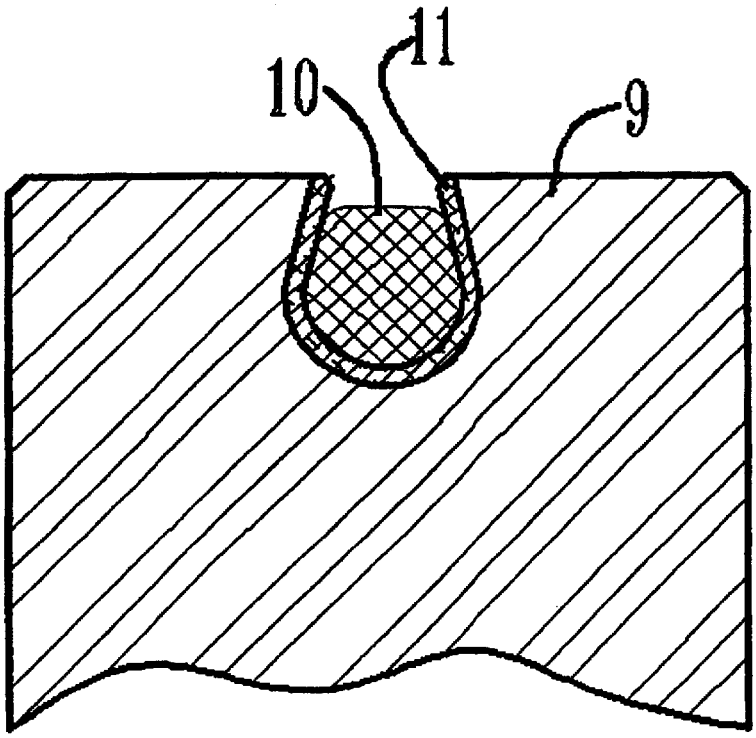

The invention is described in more detail below, with reference to the accompanying drawings, where FIG. 1 is a side-view illustration of a continuously operated extrusion device as such, seen in a partial cross-section, FIG. 2 illustrates a preferred embodiment of the invention, seen from the sectional direction A—A defined in FIG. 1, and FIG. 3 illustrates another preferred embodiment of the invention.

In the continuously operated copper extrusion device according to FIG. 1, the material 1 to be extruded is brought to a feed member 2 and further to a groove 3 provided on the circumference of the feed member 2. The extruded material located in the groove 3 is further conducted towards an abutment 4, which forces the material 1 to change direction towards an extrusion member feed plate 5 and further towards an extrusion aperture 6 located in succession to the feed plate 5. The extruded material 7 is discharged from the extrusion aperture 6 in a shape defined by said aperture.

According to FIG. 2, the groove 3 provided in a wheel 2 serving as the feed member is coated, for the part that is in contact with the material to be extruded, with a 100 micrometers thick nickel layer 8. In addition, the groove 3 is designed to be essentially U-shaped, so that the width of the groove 3 is essentially equal to the groove height, when measured at the widest and also the highest spot of the groove.

In FIG. 3, the groove 10 provided in a wheel 9 serving as the feed member of the continuously operated extrusion device is designed so that the width of the groove 10 is about 1.5 times the height of said groove 10, when measured at the widest and also the highest spot of the groove. In addition, the groove 10 is coated with a 200 micrometers thick nickel layer 11.

What is claimed is:

1. A device for producing copper or copper-based metal objects in a continuously operated extrusion device, the device comprised of an extrusion member and a rotatable feed member that is essentially wheel-shaped and has a groove formed on the circumference thereof, where the material to be extruded is brought to the extrusion member in said groove, the groove, being essentially U-shaped and defined by two side walls that are connected by a curved wall part constituting the bottom of said groove, the walls being coated with a metal coating or non-metallic coating, the coating essentially adhering well with copper or copper-based material processed in the device, but not being said copper or copper-based material processed in the device, the ratio of the groove width to the groove height being within the range 1.0–1.5, measured at the widest and highest spots of the groove.

2. A device according to claim 1, wherein the side walls deviating from the bottom of the groove are essentially parallel.

3. A device according to claim 1, wherein the side walls deviating from the bottom of the groove are curved, so that the distance between the walls is greatest essentially near to the middle of the groove height.

4. A device according to claim 1, wherein the groove is coated with a copper-adhesive metal selected from the group consisting of nickel, aluminum, zinc, cobalt, magnesium, silver, platinum, gold and mixtures or compounds thereof.

5. A device according to claim 1, wherein the thickness of the groove coating is within the range 1–1000 micrometers.

6. A device according to claim 5, wherein the thickness of the groove coating is within the range 2–100 micrometers.

7. A device according to claim 1, wherein the groove is coated with nickel.

8. A device according to claim 1, wherein the groove is coated with aluminum.

9. A device according to claim 1, wherein the groove is coated with zinc.

10. A device according to claim 1, wherein the groove is coated with cobalt.

11. A device according to claim 1, wherein the groove is coated with magnesium.

* * * * *